US006439805B1

(12) United States Patent
Ronin

(10) Patent No.: US 6,439,805 B1
(45) Date of Patent: Aug. 27, 2002

(54) METHOD OF STABILIZING THE GROUND IN ROAD CONSTRUCTION WORK

(76) Inventor: Vladimir Ronin, Skomakargatan 46, S-972 41 Luleå (SE)

( * ) Notice: Subject to any disclaimer, the term of this patent is extended or adjusted under 35 U.S.C. 154(b) by 0 days.

(21) Appl. No.: 09/701,767

(22) PCT Filed: Jun. 2, 1999

(86) PCT No.: PCT/SE99/00954

§ 371 (c)(1),
(2), (4) Date: Jan. 22, 2001

(87) PCT Pub. No.: WO99/63161

PCT Pub. Date: Dec. 9, 1999

(30) Foreign Application Priority Data

Jun. 5, 1998 (SE) ..... 9802000

(51) Int. Cl.[7] ..... E01C 7/32; E01C 3/00
(52) U.S. Cl. ..... 404/75; 404/82; 404/31
(58) Field of Search ..... 404/75, 76, 27, 404/28, 31, 34, 82; 405/266, 263; 106/694, 695, 705, 706, 707, 708, 709, 713, 714, 718, 719

(56) References Cited

U.S. PATENT DOCUMENTS 4,018,617 A * 4/1977 Nicholson ..... 106/85
4,105,463 A * 8/1978 Angelbeck ..... 106/710
4,210,457 A * 7/1980 Dodson et al. ..... 106/710
4,250,134 A * 2/1981 Minnick ..... 106/705
4,313,763 A * 2/1982 Turpin, Jr. ..... 106/679
4,328,035 A * 5/1982 Ingles et al. ..... 106/624
4,336,069 A * 6/1982 Dodson et al. ..... 106/710
4,344,796 A * 8/1982 Minnick ..... 106/705
4,373,958 A * 2/1983 Jones et al. ..... 106/706
4,436,556 A * 3/1984 Kadelka ..... 405/266
4,448,566 A * 5/1984 King ..... 404/31
4,496,267 A * 1/1985 Gnaedinger ..... 404/82
5,425,807 A * 6/1995 Riddle ..... 106/707
5,494,514 A * 2/1996 Goodson et al. ..... 106/708
5,542,977 A * 8/1996 Hanst ..... 106/706
5,716,448 A * 2/1998 Furusawa et al. ..... 106/803
5,725,652 A * 3/1998 Shulman ..... 106/709
5,804,175 A * 9/1998 Ronin et al. ..... 106/757
5,820,302 A * 10/1998 Roberts et al. ..... 405/263

FOREIGN PATENT DOCUMENTS

EP 0045026 A1 * 7/1981 ..... E01C/3/04
WO WO94/25411 * 11/1994 ..... C04B/7/38

* cited by examiner

*Primary Examiner*—Thomas B. Will
*Assistant Examiner*—Alexandra K. Pechhold
(74) *Attorney, Agent, or Firm*—Alfred J. Mangels

(57) ABSTRACT

A method of stabilizing the ground underlying roadways. Cement is mixed thoroughly with a microfill agent, and optionally a water reducing agent, to obtain a highly reactive and dry cement mixture. The dry cement mixture is blended with at least one of the materials soil, clay, or stone, and sufficient water so that after compaction the blend will have a compressive strength of at least 5 MPa after 28 days. The blend is spread on the ground to a thickness of at least 15 to 30 centimeters and a roadbed is laid over the blend after the blend has cured.

14 Claims, 1 Drawing Sheet

METHOD OF STABILIZING THE GROUND IN ROAD CONSTRUCTION WORK

BACKGROUND OF THE INVENTION

1. Field of the Invention

The present invention relates to a method of stabilizing the ground in road construction work. The method is applicable to the construction of new roads, or highways, and the reinforcement of existing roads or highways.

2. Description of the Related Art

It is necessary to stabilize weak subsoils when constructing new roads. Marshy ground and cohesive soils whose ultimate bearing resistance is too poor to support a new road construction are normally excavated down to a solid bottom and the resultant cavity refilled with suitable material, such as friction soil.

When it is necessary to excavate down to extreme depths in order to reach a solid bottom, for instance depths exceeding five meters, excavation and refilling is combined with pressing down of a heavy refill material, such as rock. When the weight of the heavy refill material becomes greater than the resistance of the underlying soil, the soil is pressed to one side. It is normally necessary to apply an overload to the ultimate road section, in order to force down the masses. It is normally necessary to leave the overload in place for a period of from 6 to 12 months before it can be removed.

Extremely fine soils are also excavated. The depth to which such soils are excavated will vary with climatic zones and also with respect to the flatness or evenness required of the finished road. Such soils can be excavated to a depth of approximately two meters.

Pronounced layers of clay soils can be piled (poled) or drained vertically.

Of the aforesaid methods, the excavation of unsuitable soil and refilling with suitable soil is the safest and often the most economical method.

However, the method causes the environment to be laden with excavated soil, etc., since these masses must be dumped in outlying tips and suitable masses taken from outlying deposits. The environment is therewith burdened by comprehensive transportation of excavated and suitable masses.

The bearing capacity of a road is often the major problem in the reconstruction of existing roads. This applies primarily when a gravel road is to be upgraded to a surfaced road. The upper construction of the road is normally replaced in such cases. Alternatively, the upper construction of the road is increased with a further construction, so as to achieve the desired bearing capacity. This procedure also requires masses to be taken from a suitable deposit and normally involves comprehensive transportation.

The present invention considerably reduces the need of excavating, refilling and transporting materials, both in the construction of new roads and when increasing the bearing capacity of an existing road.

SUMMARY OF THE INVENTION

The present invention thus relates to a method of stabilizing the ground in road construction work. A cement is mixed intensively with a microfill agent and optionally also a water reducing agent, so as to obtain a highly-reactive, dry cement mixture. The cement mixture is blended with at least one of the materials soil, clay or stone, and possibly water. The blend is laid on the ground to a thickness of at least 15–30 centimeters, causing the laid-out blend to contain sufficient cement blend to cure to obtain a compressive strength of at least 5 MPa 28 days after compaction. A roadbed is placed on top of the laid-out blend subsequent to said blend curing.

BRIEF DESCRIPTION OF THE DRAWINGS

The invention will now be described in more detail with reference to exemplifying embodiments thereof, and also with reference to the accompanying drawing, in which.

DESCRIPTION OF THE PREFERRED EMBODIMENTS

Figure 1:
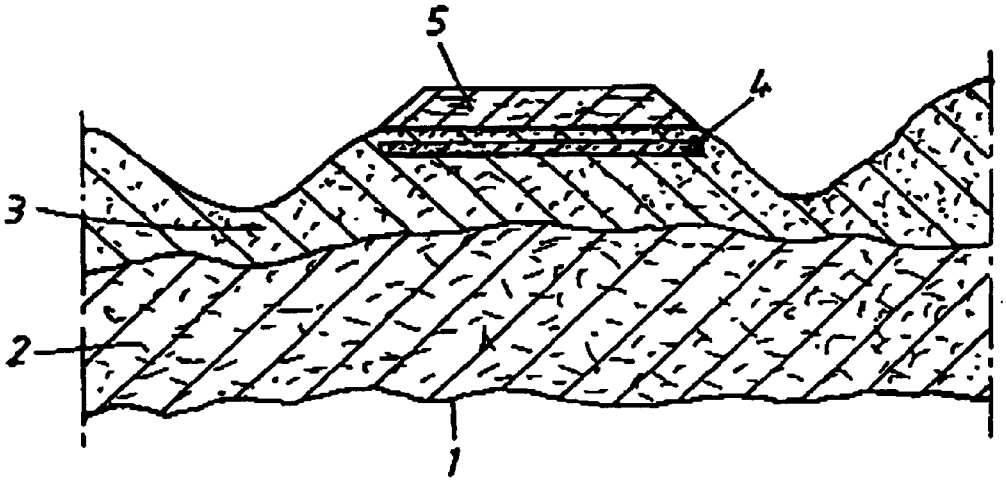
FIG. 1 illustrates a road upgrade in accordance with the invention.

The present invention relates to a method of stabilizing the ground in the construction of new roads and also of existing roads, where the bearing capacity of the ground is insufficient or where there is a serious risk of frost susceptibility.

According to the invention, cement is mixed thoroughly with microfill and possibly also a water reducing agent, so as to obtain a highly-reactive, dry cement mixture. The cement mixture is then mixed, or blended, with at least one of the materials soil, clay or stone, and possibly also water, to form a so-called blend. The soil, clay, or stone is taken from the ground on which the road is to be constructed or from the surface layer of an existing road. The resultant blend is laid out on the ground to a thickness of at least 15–30 centimeters. According to the invention, the blend laid out on the ground contains sufficient cement mixture to obtain a compressive strength of at least 5 MPa 28 days after compaction. A roadbed of conventional material is laid on top of said blend subsequent to the blend curing.

By a highly-reactive, dry cement mixture according to the foregoing and in the claims is meant a cement mixture of the kind obtained by the process described in European Patent Specification No. EP 0696262 or a cement mixture that has been treated in accordance with a corresponding process so as to obtain a compressive strength corresponding to that recited in EP 0696262.

European Patent Specification No. EP 0696262 describes a method of producing cement that can be used to produce pastes, mortar, concrete and other cement-based materials of high bearing capacity with reduced water content, high mechanical strength and density and rapid strength development. The method includes the mechanical-chemical treatment of cement and comprises two-stage mechanical treatment of a mixture of cement and at least one of two components, wherein the first component is a microfill that contains silicon dioxide and the second component is a polymer in the form of a powdery water reducing agent. The cement and the first and/or the second component are mixed in the first stage in a dry state, wherein the particles of the first and/or the second component are adsorbed on the cement particles. The mixture obtained in the first stage is treated in the second stage in a grinder in which the particles in said mixture are subjected to a large number of impact pulses which change directions in a rapid sequence and therewith result in modification of the surface properties of the cement particles in the form of a considerable increase in surface energy and chemical reactivity. Treatment in the second stage is continued for a length of time sufficient for a cement-paste cube having a side length of 20 mm and compressed thoroughly under vibration and cured at +20° C. under closed conditions to obtain a one-day compressive strength equal to at least 60 MPa.

The cement used is preferably Portland cement. The microfill may, for instance, be fly ash or some other commercially available microfill. The water reduction agent may be any commercially available water reducing agent, for instance the agent marketed under the name "Mighty 100".

It has been noted above that water may be added. The amount of water required will, of course, depend on the water content of the surface layer removed and blended with the cement mixture. The person skilled in this art will have no difficulty in adding the correct amount of water to obtain the correct water/cement ratio.

According to one preferred embodiment, the weight ratio of cement to other material or materials in the laid-out blend is from 5%: 95% to 30%: 70%.

According to one embodiment, the upper lay of an existing roadbed is removed. This layer will normally contain gravel and sand. The layer is normally removed with the aid of a road planer, bulldozer or cutter adapted to tear up the surface layer of the road. The cutter may be pulled by a tractor or like vehicle. The surface layer is removed conveniently to a depth of from about 15 centimeters to 50 centimeters. The removed surface material is mixed with the cement blend and possibly also water, after which the resultant blend is laid out on the roadbed. This is illustrated in FIG. 1.

The removed material may be mixed with the cement mixture in a cement mixer. The resultant material may be applied to the road surface, by pouring the material onto said surface. Simple forms may be installed at the sides of the road surface so as to limit the width and length to which the blend is laid-out.

The blend laid-out on said road surface will preferably be compacted so as to impart sufficient mechanical strength thereto. This compaction can be effected by vibrating the laid-out blend in a known manner.

According to one preferred embodiment, this compaction is effected in a form so as to produce slab-like elements that can then be placed on the ground.

FIG. 1 is a cross-sectional view of an existing road or highway subsequent to treatment in accordance with the inventive method. The reference numeral 1 identifies a solid bottom, for instance a rock bottom, the reference numeral 2 identifies the subsoil that needs to be stabilized, and the reference numeral 3 identifies the old roadbed. The subsoil 2 may consist of sand, clay, different soils or other material. The reference number 4 in FIG. 1 identifies the laid-out blend of cement mix and earlier road surface layer. The reference numeral 5 identifies a conventional roadbed that has been laid-out after the material 4 has cured.

According to another embodiment, existing ground material, such as soil, clay and sand, is removed when constructing a new road or highway and is blended with said cement mixture and possible also water, whereafter the resultant blend is laid-out on the ground to form a foundation for a future roadbed. The steps of removing said material, blending the material with said cement mixture, compacting the blend and applying the blend to the ground can be effected in a manner corresponding to that described above.

Figure 2:
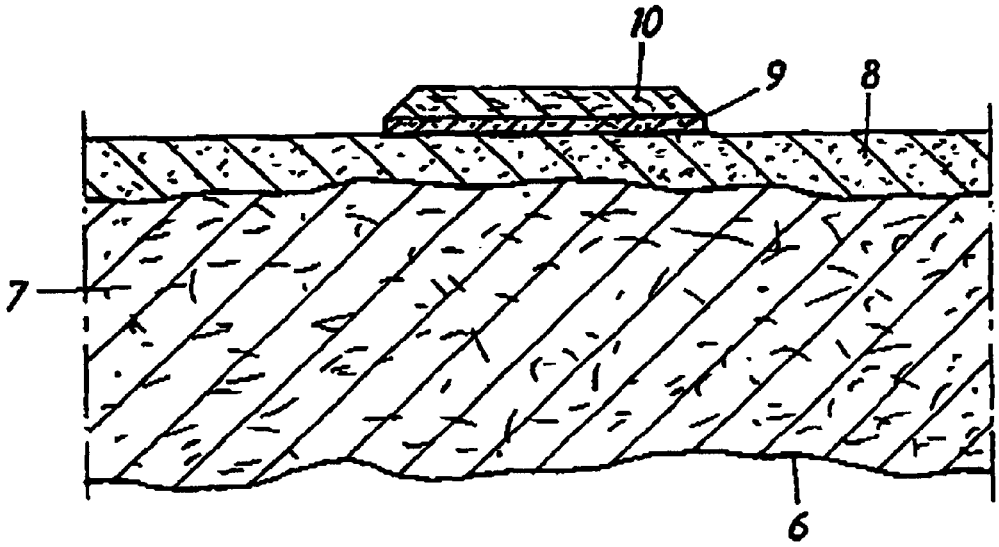
FIG. 2 is a cross-sectional view of a road newly constructed in accordance with the invention.

FIG. 2 is a cross-sectional view of a newly constructed road where the present invention has been applied. The reference numeral 6 identifies a solid bottom, for instance a rock bottom, the reference numeral 7 identifies the ground that needs to be stabilized, and the reference numeral 8 identifies a ground surface layer. The subsoil may consist of sand, clay, different soils or other material. The reference numeral 9 in FIG. 2 identifies the laid-out blend of cement mixture and surface layer material. The reference numeral 10 identifies a conventional roadbed that has been laid after the material 9 has cured.

According to one preferred embodiment, with respect to the improvement of an existing road and the construction of a new road, the compacted blend or mixture is spread over the ground to a width which exceeds the width of the roadway under construction.

It has been found that when using a surface layer from an existing road and when using the ground material in the construction of a new road these materials react with the highly-reactive cement mixture such as to form a slab 4, 9 of such high mechanical strength as to sufficiently stabilize the subsoil. This obviates the need for the previously-noted complicated and disadvantageous stabilizing methods.

Stabilization of the masses in the road path changes the properties of the masses such as to reduce frost susceptibility and such as to greatly increase the bearing capacity of the road, thereby rendering suitable for road construction purposes masses that were earlier unsuitable to this end.

Uneven settling in the roadbed is also reduced. In the case of very weak subsoils, the stabilized material can be supplemented with reinforcing means, e.g. in the form of known reinforcement mats or netting.

Thus, stabilization enables a road to be constructed on very weak subsoil without requiring environmentally-detrimental excavation, and also in a cost-effective manner.

Existing roads that have a low bearing capacity can be stabilized to achieve an intended bearing capacity by simply applying a thin bearing layer, without needing to excavate or shift the soil or apply thick superstructures of refined natural gravel or stone taken from outlying deposits.

It will be apparent that fresh material, such as sand or gravel, can be mixed with the surface material that is blended with the cement mixture.

Although the invention has been described above with reference to exemplifying embodiments thereof, it will be understood that variations can be made with respect to road construction work. For instance, a thin layer of sand, pebbles or gravel laid-out on the future roadway can be levelled to form a flat surface on which the blend can then be spread out.

The invention is therefore not restricted to the hereindescribed and illustrated embodiments thereof, since variations can be made within the scope of the following claims.

What is claimed is:

1. A method of stabilizing the ground in road construction work, said method comprising the steps of: preparing a cement mixture by thoroughly mixing cement with a microfill agent to obtain a highly-reactive and dry cement mixture that when hydrated has a one-day compressive strength of at least 60 MPa for a cement paste cube having a side length of 20 mm and having been compressed under vibration and cured at +20° C. under closed conditions; blending the cement mixture with at least one of the materials soil, clay, and stone and sufficient water to obtain a predetermined water content of the blend , wherein the blend contains sufficient cement mixture so that after compaction said blend will have a compressive strength of at least 5 MPa after 28 days; spreading the blend on the ground to a thickness of at least 15–30 centimeters; and laying a roadbed over the blend after the blend has cured.

2. A method according to claim 1, including the steps of: removing an upper layer of an existing roadbed; and adding upper layer material to said cement mixture; and thereafter laying the resultant blend on the remaining roadbed.

3. A method according to claim 1, including the steps of: removing existing ground material such as soil, clay and stone to prepare a new roadway; and mixing removed ground material with said cement mixture to provide a blend of removed ground material and cement mixture; and thereafter laying the blend on the ground to form a foundation for a future, overlying roadbed.

4. A method according to claim 1, wherein the weight ratio of cement to other material in the blend is from 5%: 95% to 30%: 70%.

5. A method according to claim 1, including the steps of compacting said blend to form a slab-like element, and laying said slab-like element on the ground.

6. A method according to claim 5, wherein the compacted blend is laid on the ground to a width that exceeds the width of a future roadway.

7. A method according to claim 1, including the step of reinforcing the blend with a reinforcing element.

8. A method according to claim 1, including the step of adding a water reducing agent to the cement mixture.

9. A method according to claim 7, wherein the reinforcing element is a reinforcing net.

10. A method according to claim 1, wherein the at least one of the materials soil, clay, and stone is obtained from the ground over which a road is to be constructed, to reduce the need to transport excavated road base material away from an existing road construction site and to reduce the need to transport to the existing road construction site the at least one of the materials soil, clay, and stone from sites remote from the road construction site.

11. A method according to claim 1, wherein materials to be blended into the cement mixture to provide ground stabilization are obtained from one of the ground over which a road is to be constructed, removed surface material of a preexisting roadbed, and combinations and mixtures thereof, to reduce the need to transport excavated road base material away from an existing road construction site and to reduce the need to transport to the road construction site the at least one of the materials soil, clay, and stone from sites remote from the road construction site.

12. A method of stabilizing the ground in road construction work, said method comprising the steps of: preparing a cement mixture by thoroughly mixing cement with a microfill agent to obtain a highly-reactive and dry cement mixture that when hydrated has a one-day compressive strength of at least 60 MPa for a cement paste cube having a side length of 20 mm and having been compressed under vibration and cured at +20° C. under closed conditions; blending the cement mixture with at least one of the materials soil, clay, and stone and sufficient water to obtain a predetermined water content of the blend; removing an upper layer of an existing roadbed; adding removed upper layer material to said cement mixture; spreading the blend on the ground to a thickness of at least 15–30 centimeters, wherein the blend that is spread out on the ground contains sufficient cement mixture so that after compaction said blend will have a compressive strength of at least 5 MPa after 28 days; laying the resultant blend on the remaining roadbed; and laying a roadbed over the blend after the blend has cured.

13. A method of stabilizing the ground in road construction work, said method comprising the steps of: preparing a cement mixture by thoroughly mixing cement with a microfill agent to obtain a highly-reactive and dry cement mixture that when hydrated has a one-day compressive strength of at least 60 MPa for a cement paste cube having a side length of 20 mm and having been compressed under vibration and cured at +20° C. under closed conditions; removing existing ground material such as soil, clay and stone to prepare a new roadway; and mixing removed ground material with said cement mixture to provide a blend of removed ground material and cement mixture; blending the cement mixture with at least one of the materials soil, clay, and stone and sufficient water to obtain a predetermined water content of the blend; spreading the blend on the ground to a thickness of at least 15–30 centimeters to form a foundation for a future, overlying roadbed, wherein the blend that is spread out on the ground contains sufficient cement mixture so that after compaction said blend will have a compressive strength of at least 5 MPa after 28 days; and laying a roadbed over the blend after the blend has cured.

14. A method of stabilizing the ground in road construction work, said method comprising the steps of: preparing a cement mixture by thoroughly mixing cement with a microfill agent to obtain a highly-reactive and dry cement mixture that when hydrated has a one-day compressive strength of at least 60 MPa for a cement paste cube having a side length of 20 mm and having been compressed under vibration and cured at +20° C. under closed conditions; blending the cement mixture with at least one of the materials soil, clay, and stone and sufficient water to obtain a predetermined water content of the blend; spreading the blend on the ground to a thickness of at least 15–30 centimeters, wherein the blend that is spread out on the ground contains sufficient cement mixture so that after compaction said blend will have a compressive strength of at least 5 MPa after 28 days; reinforcing the blend with a reinforcing element, wherein the reinforcing element is a reinforcing net; and laying a roadbed over the blend after the blend has cured.

* * * * *